US009863729B2

(12) United States Patent
Blank

(10) Patent No.: US 9,863,729 B2
(45) Date of Patent: Jan. 9, 2018

(54) BREECH BOLT HAVING ASYMMETRIC LUGS

(71) Applicant: Sharps Rifle Company, Inc., Glenrock, WY (US)

(72) Inventor: Michael H. Blank, Chesterfield, MO (US)

(73) Assignee: Sharps Rifle Company, Inc., Glenrock, WY (US)

( * ) Notice: Subject to any disclaimer, the term of this patent is extended or adjusted under 35 U.S.C. 154(b) by 430 days.

(21) Appl. No.: 14/205,960

(22) Filed: Mar. 12, 2014

(65) Prior Publication Data

US 2015/0260467 A1 Sep. 17, 2015

(51) Int. Cl.
*F41A 3/30* (2006.01)
*F41A 3/26* (2006.01)

(52) U.S. Cl.
CPC *F41A 3/30* (2013.01); *F41A 3/26* (2013.01); *Y10T 29/4973* (2015.01)

(58) Field of Classification Search
CPC ..... F41A 3/12–3/16; F41A 3/26–3/30; F41A 5/14
USPC .... 42/14–16, 25, 69.02, 2; 89/180, 184–185
See application file for complete search history.

(56) References Cited

U.S. PATENT DOCUMENTS 2,655,837 A * 10/1953 Johnson ..... F41A 9/29 42/25
2,951,424 A 9/1960 Stoner
3,035,495 A 5/1962 Stoner
3,198,076 A 8/1965 Stoner
4,655,118 A * 4/1987 Bruderer ..... F41A 3/30 89/185
4,764,224 A 8/1988 Morris
5,351,598 A * 10/1994 Schuetz ..... F41A 5/18 42/25
5,499,569 A * 3/1996 Schuetz ..... F41A 15/12 42/25
5,911,173 A * 6/1999 Westrom ..... F41A 15/12 89/185
6,044,580 A 4/2000 Gussalli Beretta
6,508,025 B1 * 1/2003 Du Plessis ..... F41A 15/12 42/16
6,609,319 B1 * 8/2003 Olson ..... F41A 3/26 42/16
6,622,606 B1 9/2003 Neal
6,634,274 B1 10/2003 Herring
6,681,677 B2 1/2004 Herring
6,722,255 B2 4/2004 Herring
6,978,709 B2 * 12/2005 Aalto ..... F41A 3/30 89/185

(Continued)

*Primary Examiner* — Stephen Johnson
*Assistant Examiner* — Benjamin S Gomberg
(74) *Attorney, Agent, or Firm* — Senniger Powers LLP

(57) ABSTRACT

A firearm including a receiver, a barrel, a breech bolt assembly, and a trigger assembly. The bolt assembly has a bolt including a body portion, a lug portion, and a firing pin bore. The lug portion includes outward extending lugs, a cartridge recess, and an off-center hole. The bolt assembly also includes an extractor and an ejector pin. At least some of the lugs on the lug portion of the bolt have a tapering outer surface so that a rearward surface of the respective lug is taller than a forward surface of the respective lug and at least part of each tapered outer surface is taller on one side of a circumferential centerline than on another side of the circumferential centerline.

16 Claims, 9 Drawing Sheets

(56) References Cited

U.S. PATENT DOCUMENTS

| | | | | |
|---|---|---|---|---|
| 7,040,213 | B2 | 5/2006 | Herring | |
| 7,331,135 | B2 * | 2/2008 | Shimi | F41A 3/66 42/16 |
| 7,428,795 | B2 | 9/2008 | Herring | |
| 9,032,860 | B2 * | 5/2015 | Faxon | F41A 15/14 89/193 |
| 9,234,713 | B1 * | 1/2016 | Olson | F41A 15/14 |
| 2014/0075807 | A1 * | 3/2014 | Lewis | F41A 3/12 42/25 |

* cited by examiner

BREECH BOLT HAVING ASYMMETRIC LUGS

BACKGROUND

The present invention relates to firearm breech bolt assemblies, and more particularly, but not exclusively, to a breech bolt having improved reliability.

Automatic rifles have been standard weapons of choice for the armed forces and police SWAT units. These weapons also have semi-automatic counterparts which are popular with civilians. Many of these automatic and semi-automatic firearms are based on a gas-operated breech bolt carrier system. U.S. Pat. Nos. 2,951,424 and 3,198,076 both to Stoner provide early examples of these types of weapons. Generally, the bolt carrier system of these weapons includes a multi-lug breech bolt that interlocks with lugs on a bolt receiver for firing each round of ammunition. The pressurized gases resulting from the weapon firing a bullet are directed to slide the breech bolt backward and then forward in the receiver, ejecting a spent shell casing and loading a new cartridge from a magazine adjacent the receiver.

Occasionally, the breech bolt becomes misaligned with the receiver when in the bolt is moving forward so the lugs on the breech bolt are no longer aligned with gaps between the lugs on the receiver. When the lugs and gaps slots are out of alignment, the bolt cannot slide forward to chamber the new cartridge and the bolt becomes jammed. Jammed bolts limit the overall reliability of the weapon. By reducing the frequency of jammed bolts, maintenance-actions for the gun are correspondingly reduced and overall reliability is improved. Consequently, there is a need to better ensure the bolt lugs properly mesh with the receiver gaps.

SUMMARY

In one aspect, the present invention includes a firearm for firing a projectile from a cartridge including a shell casing having a hollow interior. The cartridge also includes propellant in the interior of the shell casing. The projectile is mounted at a forward end of the shell casing. The firearm comprises a receiver having a cavity therein and a barrel interface at a forward end. The barrel interface includes a bolt interlocking chamber and receiver lugs spaced by gaps and extending inward behind the bolt interlocking chamber. The firearm also has an elongate barrel mounted on the barrel interface for directing the projectile forward when fired from the cartridge. The barrel includes a firing chamber at a rearward end for holding the cartridge prior to firing the projectile and for holding the shell casing after the projectile is fired. The firing chamber is positioned in front of the bolt interlocking chamber. Further, the firearm includes a breech bolt assembly mounted in the receiver cavity behind the barrel interface for loading the cartridge in the firing chamber from a cartridge source prior to firing and extracting the shell casing from the firing chamber after firing. The bolt assembly comprises a bolt including an elongate cylindrical body portion having a longitudinal centerline, a lug portion extending forward from the body portion, and a firing pin bore extending through the bolt parallel to the longitudinal centerline. The lug portion includes outwardly extending lugs, a cartridge recess at a front end sized and shaped for holding a rearward end of the cartridge, and an off-center longitudinal hole at least partially aligned with the cartridge recess. The lugs are spaced to correspond to the gaps between the receiver lugs so that the bolt lugs can slide forward through the gaps and rotate about the centerline of the body portion to align at least some of the bolt lugs with at least some of the receiver lugs. An extractor pivotally mounted in the extractor cavity is biased to hold the cartridge in the cartridge recess. The bolt assembly also includes an ejector pin slidably received in the off-center longitudinal hole. The pin is biased to eject the shell casing from the cartridge recess. In addition, the firearm comprises a trigger assembly including a firing pin slidably received in the firing pin bore of the bolt and aligned with the cartridge when received in the cartridge recess and firing chamber for initiating firing of the projectile from the cartridge. At least some of the lugs on the lug portion of the bolt have a tapered outer surface so that a rearward surface of the respective lug has a greater radial height than a forward surface and at least part of each tapered outer surface has a greater radial height on one side of a circumferential centerline than on another side of the circumferential centerline.

In another aspect, the present invention includes a breech bolt assembly for mounting in a firearm for loading a cartridge in a firing chamber of the firearm prior to firing a projectile from the cartridge and extracting a shell casing from the firing chamber after firing. The bolt assembly comprises a bolt including an elongate cylindrical body portion having a longitudinal centerline, a lug portion extending forward from the body portion, and a firing pin bore extending through the bolt parallel to the longitudinal centerline. The lug portion includes spaced outwardly extending lugs, a cartridge recess at a front end sized and shaped for holding a rearward end of the cartridge, and an off-center longitudinal hole at least partially aligned with the cartridge recess. The bolt assembly also has an extractor pivotally mounted in the extractor cavity and biased to hold the cartridge in the cartridge recess. Further, the bolt assembly includes an ejector pin slidably received in the off-center longitudinal hole. The pin is biased to eject the shell casing from the cartridge recess. At least some of the lugs on the lug portion of the bolt have a tapering outer surface so that a rearward surface of the respective lug has a greater radial height than a forward surface of the respective lug and each tapering outer surface is asymmetrically rounded about its circumferential centerline.

In yet another aspect, the present invention includes a method for increasing reliability of a firearm. The method comprises removing a used breech bolt from the firearm and installing a new breech bolt in the firearm. The new bolt includes lugs have a tapering outer surface so that a rearward surface of each respective lug has a greater radial height than a forward surface of the respective lug and at least part of each tapered outer surface has a greater radial height on one side of a circumferential centerline than on another side of the circumferential centerline.

In still another aspect, the present invention includes a method for increasing reliability of a firearm. The method comprises removing a breech bolt having lugs from the firearm and reworking the breech bolt so at least some of the lugs have a tapering outer surface. The outer surface tapers so that a rearward surface of each respective lug has a greater radial height than a forward surface of the respective lug and at least part of each tapered outer surface has a greater radial height on one side of a circumferential centerline than on another side of the circumferential centerline. The reworked breech bolt is installed in the firearm.

A further aspect of the present invention includes a breech bolt assembly for mounting in a firearm for loading a cartridge in a firing chamber of the firearm prior to firing a projectile from the cartridge and extracting a shell casing from the firing chamber after firing. The bolt assembly comprises a bolt including an elongate cylindrical body portion having a longitudinal centerline, a lug portion extending forward from the body portion, and a firing pin bore extending through the bolt parallel to the longitudinal centerline. The lug portion includes spaced outwardly extending lugs, a cartridge recess at a front end sized and shaped for holding a rearward end of the cartridge, and an off-center longitudinal hole at least partially aligned with the cartridge recess. The bolt assembly also includes an extractor pivotally mounted in the extractor cavity and biased to hold the cartridge in the cartridge recess and an ejector pin slidably received in the off-center longitudinal hole. The pin is biased to eject the shell casing from the cartridge recess. At least some of the lugs on the lug portion of the bolt are circumferentially tapered, having a greater radial height on one side of a circumferential centerline than on another side of the circumferential centerline.

Yet another aspect of the present invention includes a breech bolt assembly for mounting in a firearm for loading a cartridge in a firing chamber of the firearm prior to firing a projectile from the cartridge and extracting a shell casing from the firing chamber after firing. The bolt assembly comprises a bolt including an elongate cylindrical body portion having a longitudinal centerline, a lug portion extending forward from the body portion, and a firing pin bore extending through the bolt parallel to the longitudinal centerline. The lug portion includes outwardly extending spaced lugs. The bolt has a cartridge recess at a front end sized and shaped for holding a rearward end of the cartridge, and an off-center longitudinal hole at least partially aligned with the cartridge recess. The bolt assembly has an extractor pivotally mounted in the extractor cavity and biased to hold the cartridge in the cartridge recess. The assembly also has an ejector pin slidably received in the off-center longitudinal hole. The pin is biased to eject the shell casing from the cartridge recess. At least some of the lugs on the lug portion of the bolt are asymmetrically rounded, having a larger radius of curvature on one side of a circumferential centerline than on another side of the circumferential centerline.

In a final aspect, the present invention includes a firearm for firing a projectile from a cartridge including a shell casing having a hollow interior, propellant in the interior of the shell casing, and the projectile mounted at a forward end of the shell casing. The firearm comprises a receiver having a cavity therein and a barrel interface at a forward end. The barrel interface includes a bolt interlocking chamber and receiver lugs spaced by gaps and extending inward behind the bolt interlocking chamber. The firearm also comprises an elongate barrel mounted on the barrel interface for directing the projectile forward when fired from the cartridge. The barrel includes a firing chamber at a rearward end for holding the cartridge prior to firing the projectile and for holding the shell casing after the projectile is fired. The firing chamber is positioned in front of the bolt interlocking chamber. In addition, the firearm includes a breech bolt assembly mounted in the receiver cavity behind the barrel interface for loading the cartridge in the firing chamber from a cartridge source prior to firing and extracting the shell casing from the firing chamber after firing. The bolt assembly comprises a bolt including an elongate cylindrical body portion having a longitudinal centerline, a lug portion extending forward from the body portion, and a firing pin bore extending through the bolt parallel to the longitudinal centerline. The lug portion includes outwardly extending lugs. The bolt has a cartridge recess at a front end sized and shaped for holding a rearward end of the cartridge and an off-center longitudinal hole at least partially aligned with the cartridge recess. The lugs are spaced to correspond to the gaps between the receiver lugs so that the bolt lugs can slide forward through the gaps and rotate about the centerline of the body portion to align at least some of the bolt lugs with at least some of the receiver lugs. The bolt assembly has an extractor pivotally mounted in the extractor cavity and biased to hold the cartridge in the cartridge recess and an ejector pin slidably received in the off-center longitudinal hole. The pin is biased to eject the shell casing from the cartridge recess. The firearm has a trigger assembly including a firing pin slidably received in the firing pin bore of the bolt and aligned with the cartridge when received in the cartridge recess and firing chamber for initiating firing of the projectile from the cartridge. At least some of the lugs on the lug portion of the bolt have less material on one forward outer corner than on another forward outer corner so that the bolt tends to circumferentially rotate in a direction away from the corner having less material when contacting the receiver lugs as the bolt slides forward in the receiver cavity.

Other aspects of the present invention will be apparent in view of the following description and claims.

BRIEF DESCRIPTION OF THE DRAWINGS

Corresponding reference characters indicate corresponding parts throughout the drawings.

DETAILED DESCRIPTION OF THE DRAWINGS

Figure 1:
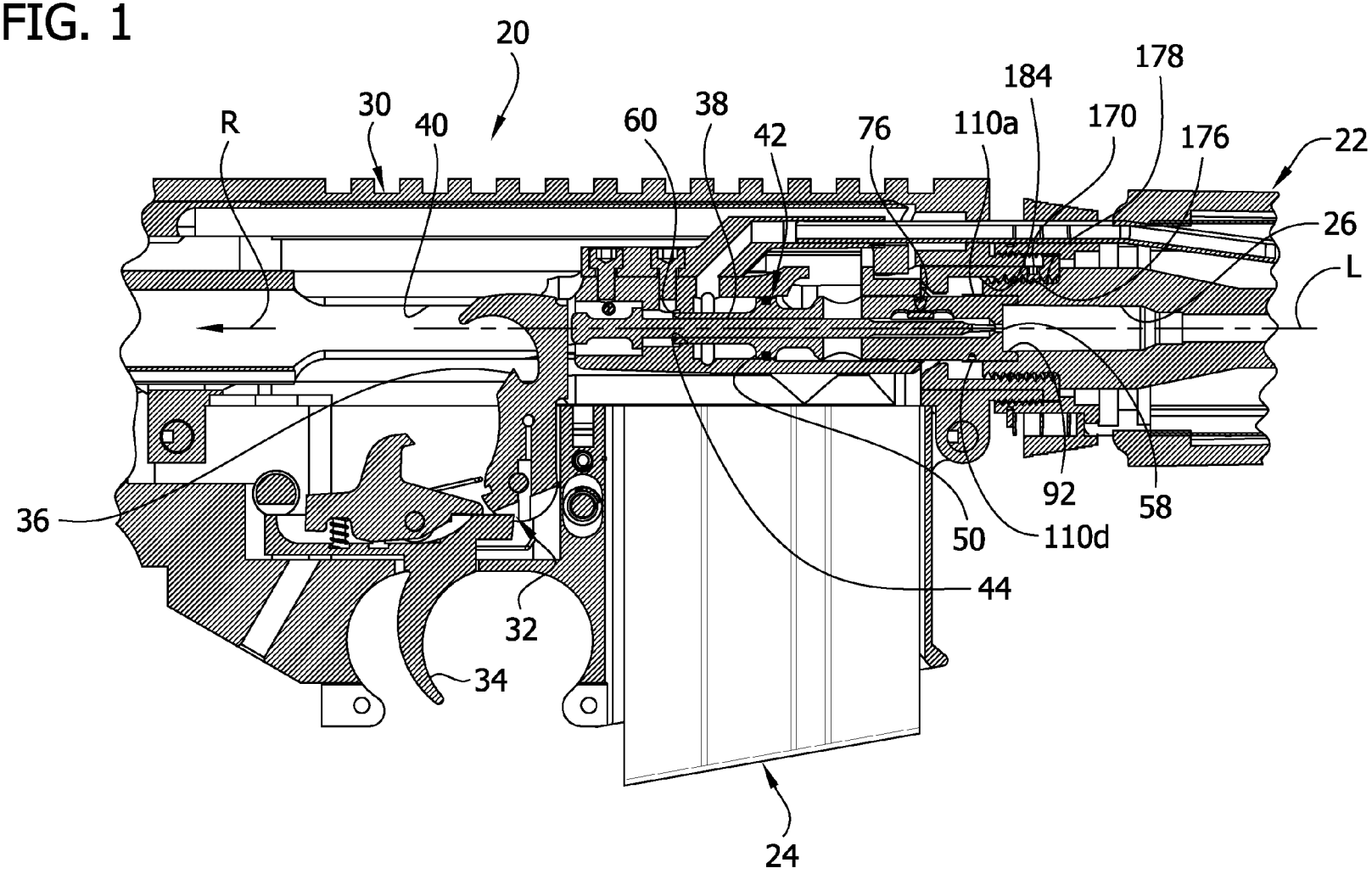
FIG. 1 is a fragmentary cross section of a firearm of one embodiment of the present invention.

Referring to FIG. 1, a firearm incorporating one embodiment of the present invention is designated in its entirety by the reference number 20. The firearm 20 has a barrel 22 and a cartridge source such as a magazine 24. The magazine 24 is configured to sequentially feed cartridges to a firing chamber 26 through a receiver 30. The receiver 30 includes a trigger assembly 32 with a trigger 34, a hammer 36, and a firing pin 38. Both of the trigger 34 and the hammer 36 are biased toward a forward position. The receiver 30 has a cavity 40 configured to house a breech bolt assembly 42. The breech bolt assembly 42 has a firing pin bore 44 through which the firing pin 38 extends. The breech bolt assembly 42 also includes a spring-loaded extractor 46 and a breech bolt 50. The extractor 46 has a guide flange 52 and is pivotably coupled by a pivot pin 54 to the breech bolt 50.

Figure 2:
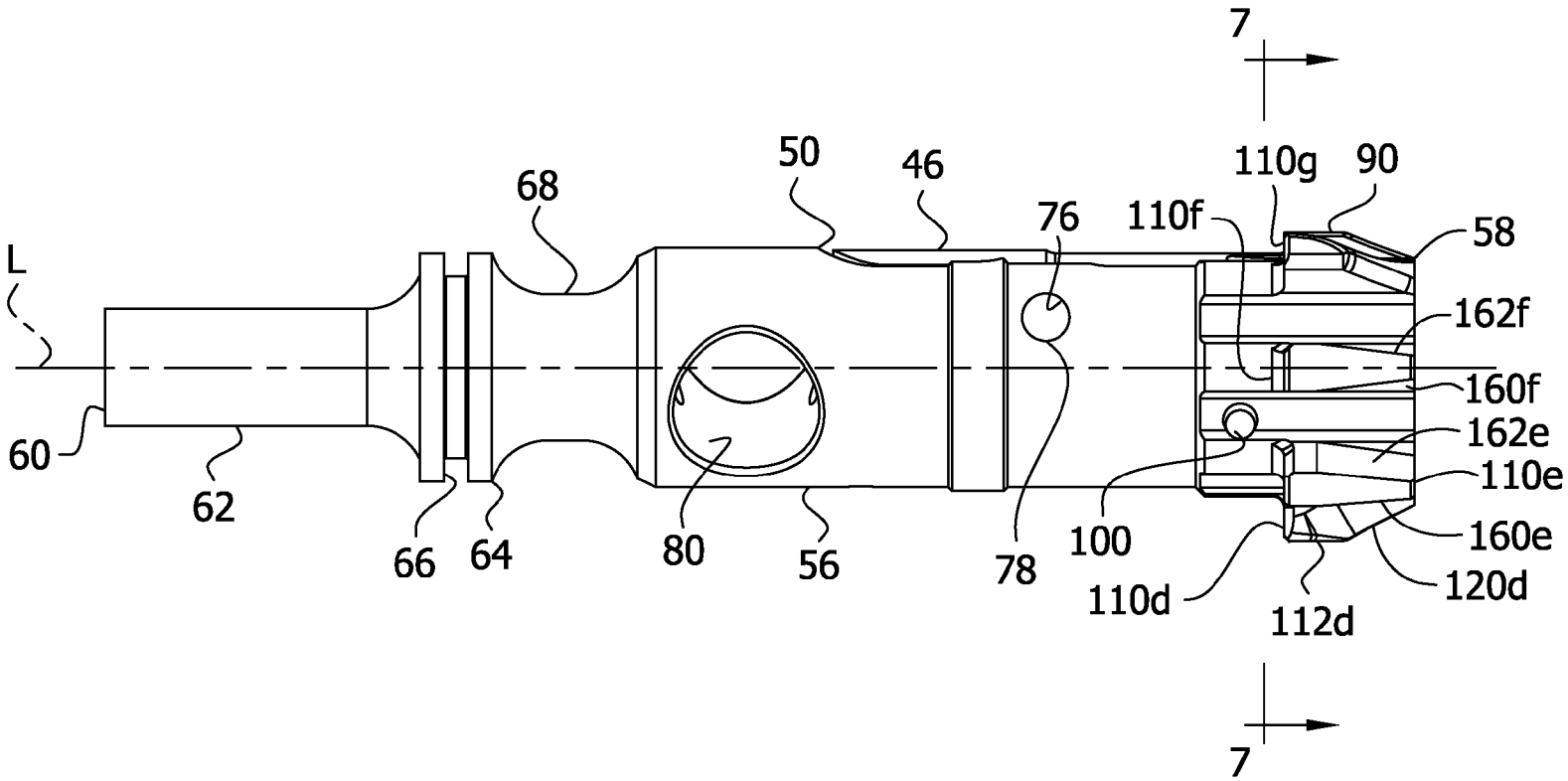
FIG. 2 is a side elevation of a breech bolt of the weapon depicted in FIG. 1.
Figure 3:
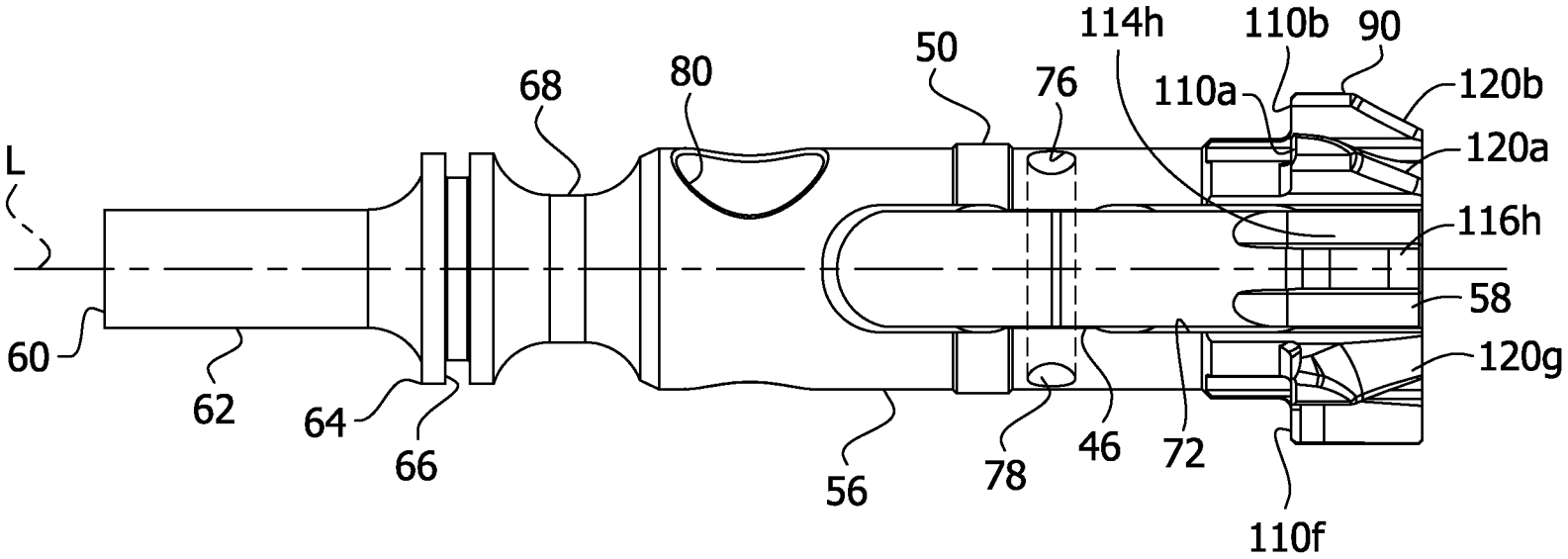
FIG. 3 is a top plan of the breech bolt depicted in FIG. 2.

As illustrated in FIGS. 2 and 3, the breech bolt 50 has a cylindrical body portion 56, as well as opposite front and back ends 58, 60, respectively, spaced along a longitudinal centerline L. A stem 62 extends longitudinally from the back end of the body portion 56. The stem 62 includes a circular sealing flange 64 having a circumferential groove 44 configured for receiving conventional sealing rings (not shown). A neck 68 separates the sealing flange 64 from the cylindrical body portion 56. The body portion 56 has a longitudinal extractor cavity 72 for receiving an extractor 46 and a lateral hole 76 intersecting the extractor cavity for receiving an extractor pivot pin 78 to hold the extractor in position in the cavity. A larger lateral hole 80 extends across the breech bolt body portion 56 behind the extractor 46 for receiving a conventional cam pin 82 to rotate the bolt 50 between an unlocked and locked position as is understood by those skilled in the art.

Figure 4:
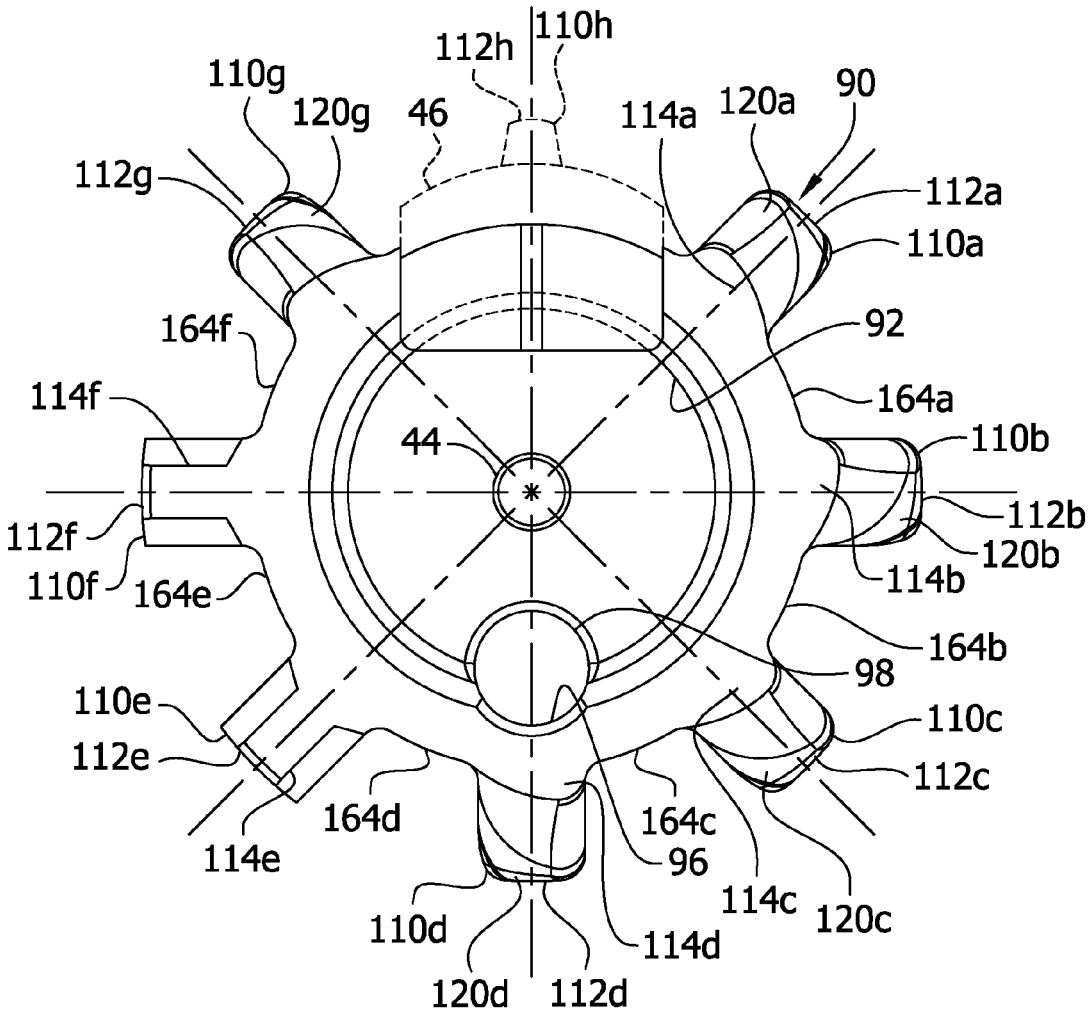
FIG. 4 is a front elevation of the breech bolt depicted in FIG. 2.

As shown in FIGS. 2-4, the breech bolt 50 also has lug portion 90 at the front end of the cylindrical body portion 56. The lug portion 90 includes a cartridge recess 92 to receive a rearward end of a chambered cartridge C. The extractor 46 is biased radially inward by a coil spring (not shown) for holding the chambered cartridge C in the cartridge recess 92. As illustrated in FIG. 4, the lug portion 90 also has an off-center, longitudinal hole 96 that extends well into the cylindrical body portion 56. The hole 96 receives an ejector pin 98 for ejecting a spent shell casing as is well known in the art. As shown in FIG. 2, the body portion 56 includes a lateral hole 100 that intersects the hole 96 for receiving a split pin (not shown) to slidably capture the ejector pin 98 in the hole. A coil spring (not shown) is positioned between the ejector pin 98 and a bottom of the hole 96 to bias the ejector pin in the forward direction. The body portion 56 includes a radial hole (not shown) that intersects the hole 96 for confirming the coil spring is in position between the pin 98 and the bottom of the hole.

The lug portion 90 has a plurality of bolt lugs 110*a-g*, extending radially about longitudinal axis L. An eighth lug 110*h* extends radially from the extractor 46. Although this eighth lug 110*h* does not function hold the bolt 50 in position against recoil forces during cartridge firing like the other lugs 110*a-g*, it projects from the extractor 46 and is intended to be included within the meaning of the term lug has used herein. The lugs 110*a-h* are evenly spaced about the bolt 50 at about 45° intervals. Lugs 110*a-g* have flat outer lands 112*a-g* spaced a common distance from the longitudinal axis L, but lug 110*h* has a flat outer land 112*h* spaced a shorter distance from the longitudinal axis (regardless of whether the extractor 46 is holding a cartridge). Lugs 110*a-g* have flat radially extending forward and rearward surfaces 114*a-g* (FIG. 4), 116*a-g* (FIG. 7), respectively, positioned at common positions along the longitudinal axis L. As shown in FIG. 3, lug 110*h*, however, has radially skewed forward and rearward surfaces 114*h*, 116*h*, respectively. As will be appreciated by those skilled in the art, the rearward surfaces 116*a-g* of lugs 110*a-g* are load-bearing surfaces during cartridge firing.

As further illustrated in FIG. 4, unlike conventional bolts, each of the lugs 110*a-d* & *g* of the bolt 50 of the illustrated embodiment has a rounded tapering outer surface 120*a-d*&*g* extending from its respective outer land 112*a-d*&*g* to its respective forward surface 114*a-d*&*g*. A detail of one lug 110*a* shown in FIG. 5 elucidates a typical shape of the rounded tapering outer surface 120*a*. Although the tapering outer surfaces 120*a-d*&*g* may have other dimensional characteristics without departing from the scope of the present invention, in one embodiment the surfaces are tapered at an angle in a range of about 5° to about 40° (measured from longitudinal along a crest of a ridgeline 122 of the outer surface), more particularly at an angle in a range of about 10° to about 32° measured from longitudinal, and still more particularly at an angle of about 21°. Although the forward surfaces 114*a-d*&*g* may have other dimensional characteristics without departing from the scope of the present invention, in one embodiment the surfaces are shorter than the forward surfaces 114*e*&*f* by a radial distance in a range of about 0.010 in. to about 0.060 in., more particularly by a radial distance in a range of about 0.025 in. to about 0.045 in., and still more particularly by a radial distance of about 0.035 in.

Figure 5:
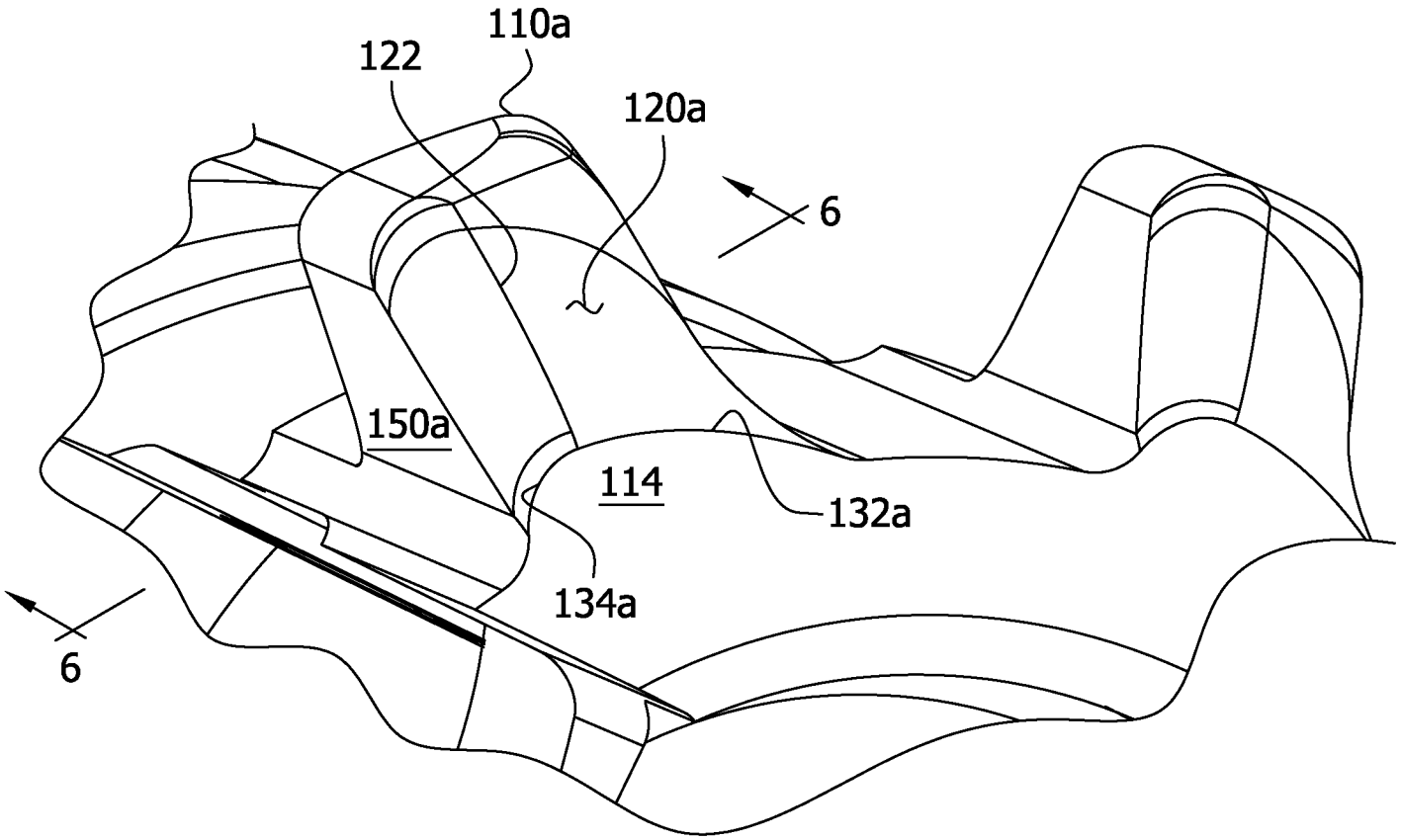
FIG. 5 is a perspective detail of a lug of the breech bolt of FIG. 2
Figure 6:
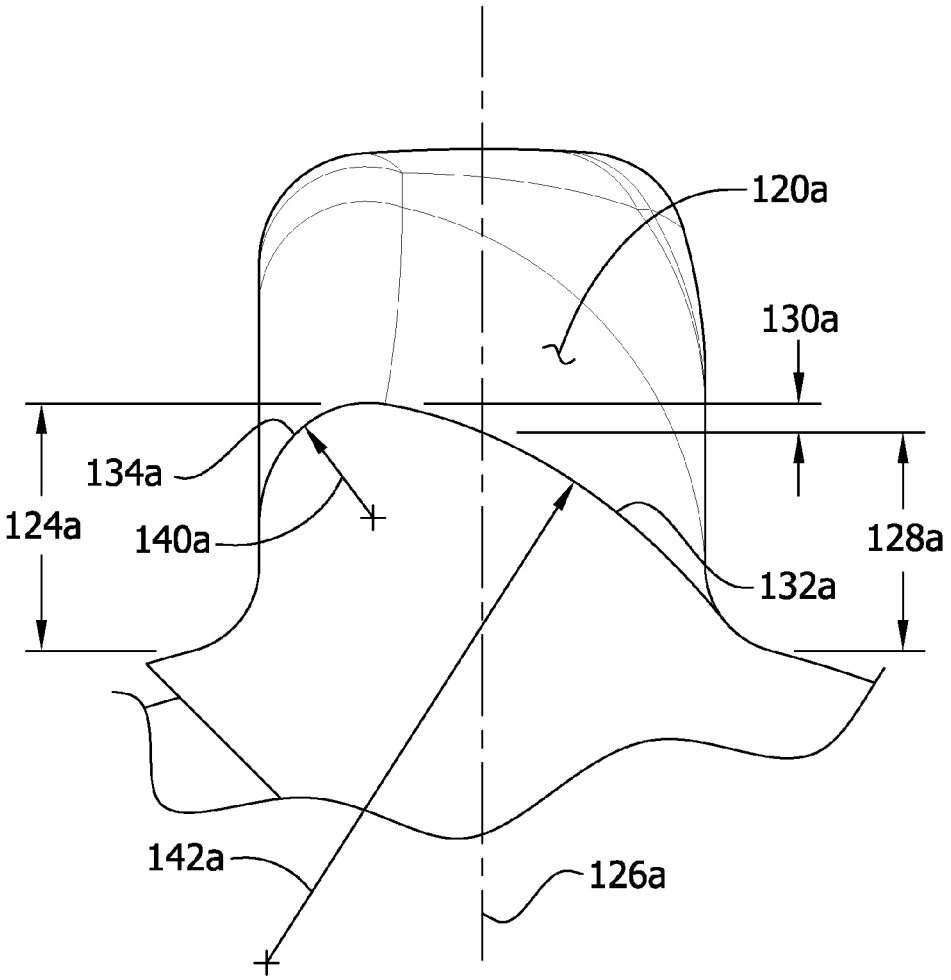
FIG. 6 is a cross section of the lug of the breech bolt taken along line 6-6 of FIG. 5.

As shown in FIGS. 5 and 6, which detail an exemplary lug 110*a*, part of each tapered outer surface 120*a* has a greater radial height 124*a* on one side of a circumferential centerline 126*a* than a radial height 128*a* on the other side of the circumferential centerline. Depending upon the particular measurements of the radial heights 124*a*, 128*a*, the tapered outer surface 120*a* may be tapered both circumferentially and axially. Although the tapering outer surface 120*a* may have other dimensional characteristics without departing from the scope of the present invention, in one embodiment the radial distance 130*a* by which the radial height 124*a* on one side of the circumferential centerline 126*a* is greater than the radial height 128*a* on the other side of the radial centerline. As a result of the circumferential tapering of the outer surface 120*a*, the lug has less material on one forward outer corner 132*a* than on the other forward outer corner 134*a*. Further, the forward outer corner having less material 132*a* slopes radially inward between the circumferential centerline 126*a* and the corner as shown in FIG. 6. In some embodiments, the forward outer corner having less material 132*a* is rounded between the circumferential centerline 126*a* and the corner. As a result of one or more of the circumferentially varying geometries described herein, the bolt 50 tends to circumferentially rotate in a direction away from the corner having less material 132*a* (depicted by arrow A in FIG. 6) when contacting the receiver lugs as the bolt slides forward in the receiver cavity.

As previously mentioned, each tapered outer surface 120*a* is rounded. More specifically, the outer surface 120*a* is asymmetrically rounded about its circumferential centerline 126*a* so a radius of curvature 140*a* on the one side of the circumferential centerline is smaller than a radius of curvature 162*a* on the other side of the circumferential centerline.

Figure 7:
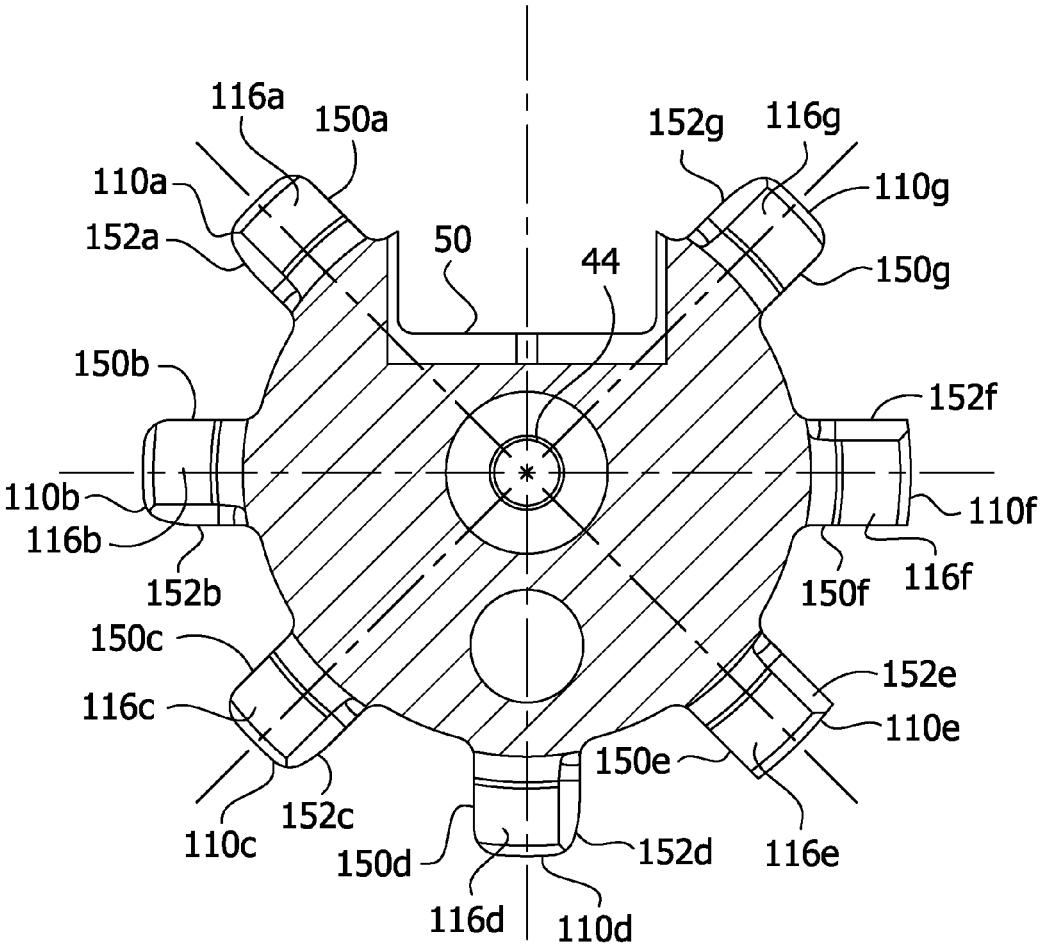
FIG. 7 is a cross section of the breech bolt taken along line 7-7 of FIG. 2.

Further, as illustrated in FIG. 7, each of the lugs 110*a-h* have circumferentially facing side surfaces 150*a-h* and 152*a-h*, extending longitudinally along the bolt 50. Although each of the side surface pairs (i.e., 150*a*, 152*a*; 150*b*, 152*b*; etc.) may taper toward each other, forming varying lug thicknesses as illustrated, those skilled in the art will appreciate that the side surface pairs may be parallel without departing from the scope of the present invention. As shown in FIG. 2, unlike conventional bolts, both of the lugs 110*e*&*f* of the bolt 50 of the illustrated embodiment have tapering surfaces 160*e*&*f*, 162*e*&*f* extending from its respective side surface 150*e* or 150*f*; 152*e* or 152*f* to its respective forward surface 114*e* or 114*f*. Although the tapering side surfaces 160*e*&*f* may have other dimensional characteristics without departing from the scope of the present invention, in one embodiment the surfaces are tapered at an angle in a range of about 2° to about 10.5° measured from longitudinal, and more particularly at an angle of about 6.25°. Although the tapering side surfaces 162*e*&*f* may have other dimensional characteristics without departing from the scope of the present invention, in one embodiment the surfaces are tapered at an angle in a range of about 2° to about 10.5° measured from longitudinal, and more particularly at an angle of about 6.25°. In some embodiments such as the illustrated embodiment, the angles of the tapering side surfaces 160*e*&*f* are equal to but opposite from the tapering side surfaces 162*e*&*f*. Although the forward surfaces 114*e*&*f* may have other dimensional characteristics without departing from the scope of the present invention, in one embodiment the surfaces are narrower than the forward surfaces 114*a-d, g*, & *h* by a thickness in a range of about 0.010 in. to about 0.081 in., and more particularly narrower than the forward surfaces by a thickness of about 0.0455 in. Further, as shown in FIG. 4, each adjacent lug pair (i.e., 110*a*, 110*b*; 110*b*, 110*c*; etc.) is spaced by a slot 164*a-h*.

Figure 8:
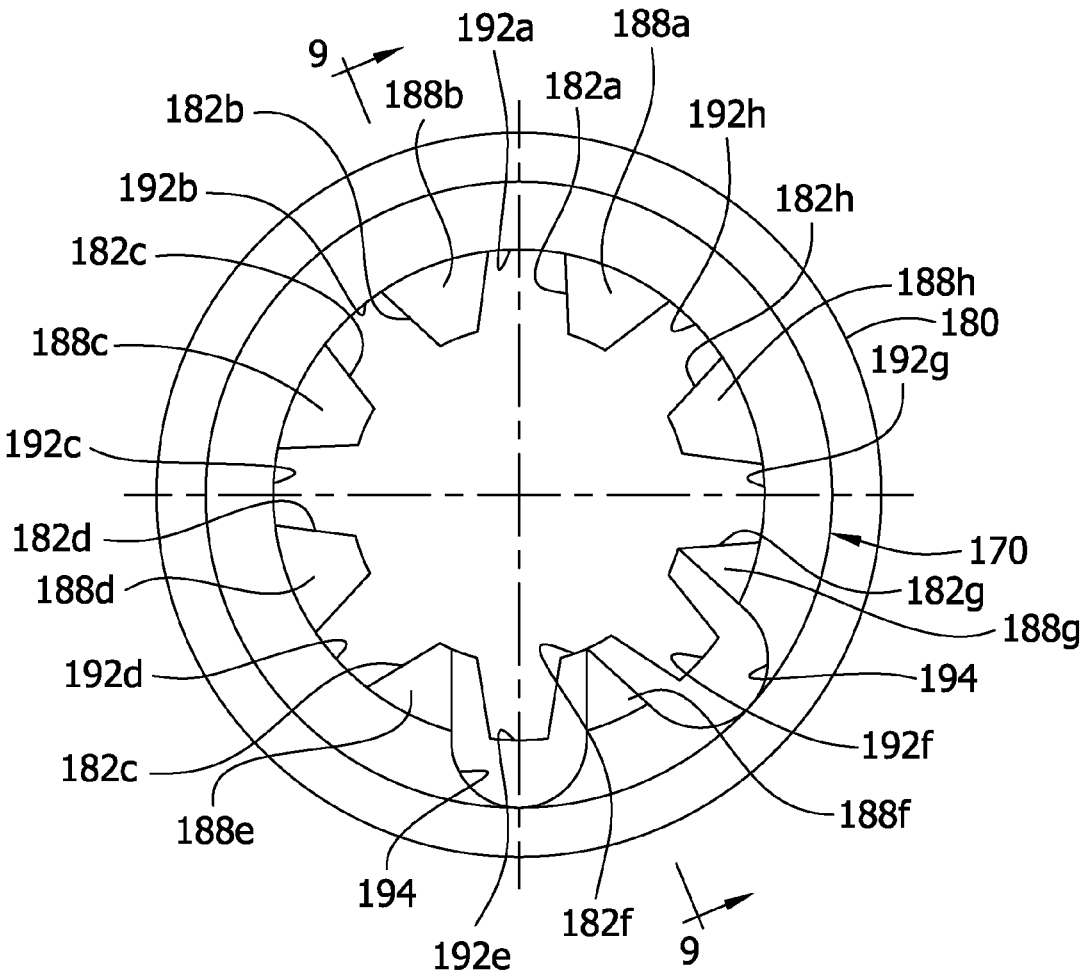
FIG. 8 is a cross section of a barrel interface of the embodiment depicted in FIG. 1.
Figure 9:
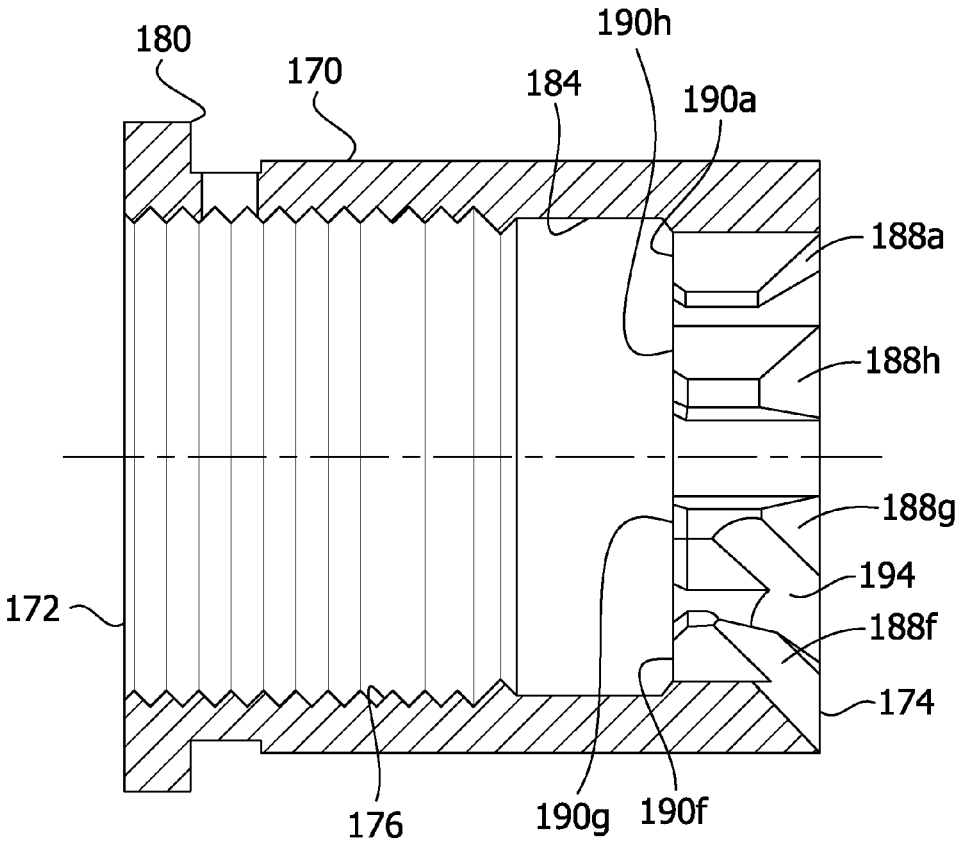
FIG. 9 is a rear elevation of the barrel interface depicted in FIG. 8.

As illustrated in FIG. 8, the receiver 30 also includes a barrel interface 170 as illustrated in FIGS. 1 and 8 that interlocks with the lug portion 90 of the breech bolt assembly 42 during firing. In some embodiments, the barrel interface 170 is configured as a barrel extension. Barrel interface 170 has forward barrel-receiving end 172 opposite a rearward bolt-receiving end 174. The barrel-receiving end 172 has an internal threaded portion 176 configured to engage threads 178 (FIG. 1) on the barrel 22 and a circumferential outer flange 180 for abutting the barrel. As shown in FIG. 9, plurality of receiver lugs 182*a-h* extend inward into the barrel interface 170 at the bolt-receiving end 174, and a bolt interlocking chamber 184 (FIG. 8) is provided inside the barrel interface between the receiver lugs and the internal threaded portion 176 of the barrel interface 170. Each of the receiver lugs 182*a-h* has a tapered rearward guide surface 188*a-h* and an opposite radial forward load-bearing surface 190*a-h*. In addition, each adjacent receiver lug pair (i.e., 182*a*, 182*b*; 182*b*, 182*c*; etc.) is spaced by a corresponding gap 192*a-h* sized and shaped for receiving corresponding bolt lugs 110*a*-110*h*. Longitudinally skewed cylindrical slots 194 extend into gaps 192*e&f* for guiding cartridges into the barrel interface 170 from the magazine 24 as will be appreciated by those skilled in the art.

In operation, the breech bolt assembly 42 moves back and forth along longitudinal axis L as cartridges are fired from the firearm 20 during a conventional automatic or semi-automatic sequence. U.S. Pat. No. 2,951,424 (Stoner), U.S. Pat. No. 3,198,076 (Stoner), and U.S. Pat. No. 5,351,598 (Schuetz) describe this conventional sequence in more detail. The sequence begins with the breech bolt assembly 42 in its rearward-most or open position (not shown). A cartridge is fed from the magazine 24 into the cartridge recess 92. Once a cartridge is positioned in the recess 92, the bolt 50 slides forward, positioning the cartridge in the firing chamber 26. As the bolt 50 moves forward, the bolt lugs 110*a-h* pass through the gaps 192*a-h* between the receiver lugs 182*a-h* of the barrel interface 170 and into the bolt interlocking chamber 184. After the bolt lugs 110*a-h* pass the receiver lugs 182*a-h*, the cam pin 82 or another conventional means rotates the breech bolt assembly 42 about the longitudinal axis L to interlock the breech in a closed position, so the rearward surfaces 116*a-g* of the bolt lugs 110*a-g* contact the forward load-bearing surfaces 190*a-g* of the receiver lugs 182*a-g*.

Once the breech bolt assembly 42 rotates into an interlocking closed position with the barrel interface 170, the cartridge in the firing chamber 26 may be fired by pulling the trigger 34. Pulling the trigger 24 causes it to pivot, releasing the hammer 36 and allowing the hammer to rotate from an engaged or cocked position to a disengaged position or firing position as shown in FIG. 1. After rotating, the hammer 36 strikes the firing pin 38, driving the pin forward in the bolt 50 to strike the cartridge in the firing chamber 26, causing it to fire. The positions of the trigger assembly 32 and the breech bolt assembly 42 just after firing are illustrated in FIG. 1.

After a cartridge is fired, the breech bolt assembly 42 rotates to disengage the bolt lugs 110*a-h* from the receiver lugs 182*a-h* and slides backward, extracting the spent shell casing before a new cartridge is loaded into the loading chamber 26 from the magazine 24. This process of sequentially loading, firing, and extracting continues through a number of cycles as determined by the shooter.

When the cartridge fires in the firing chamber 26, it transmits a recoil force on the bolt 50 in the direction indicated by arrow R. As a consequence of the recoil force, bolt lugs 110*a-g* are forced backward against the corresponding receiver lugs 182*a-g*, forming load bearing relationships between bearing surfaces 116*a-g*, 188*a-g* of the bolt 50 and barrel 170. As will be appreciated by those skilled in the art, the rounded tapered outer surfaces 120*a-d&g* and the tapering side surfaces 160*e&f*, 162*e&f* of the bolt lugs 110*e&f* prevent jamming without affecting the surface area of the bearing surfaces formed between the bolt lugs 110*a-g* and receiver lugs 182*a-g*. Thus, the bearing loads on the bolt lugs 110*a-g* and receiver lugs 182*a-g* are unchanged from conventional designs.

When the bolt 50 slides forward, the bolt lugs 110*a-h* can be out of alignment with the gaps 192*a-h* between the receiver lugs 182*a-h*. If a conventional bolt is used, this misalignment can prevent the bolt lugs 110*a-h* from passing through the receiver gaps 192*a-h*, preventing the bolt from reaching to its interlocking closed position and preventing the cartridge from being fully loaded in the firing chamber 26. Being unable to fire, the bolt 50 will not be forced backward to its open position, and the firearm may require servicing before it can be fired.

The rounded tapered outer surfaces 120*a-d&g* prevent the bolt lugs 110*a-h* from being out of alignment with the gaps 192*a-h* between the receiver lugs 182*a-h*. The rounded aspect of these surfaces 120*a-d&g* tends to guide the bolt lugs 110*a-h* circumferentially so the bolt lugs and receiver gaps 192*a-h* are circumferentially aligned. Further, the tapered aspect of the surfaces 120*a-d&g* tends to radially center the bolt lugs 110*a-h* in the receiver gaps 192*a-h*. Thus, the rounded tapered outer surfaces 120*a-d&g* properly align the bolt lugs 110*a-h* with the gaps 192*a-h* and prevent jamming due to misalignment.

The tapering side surfaces 160*e&f*, 162*e&f* prevent the bolt lugs 110*e&f* from circumferentially interfering with the corresponding receiver lugs 182*e-g*, even when the bolt lugs 110*a-h* are circumferentially misaligned with the receiver gaps 192*a-h*. Further, the forward surfaces 114*e&f* of the bolt lugs 110*e&f* are of conventional height so the bolt lugs can push cartridges along the longitudinally skewed slots 194 in the barrel interface 170 to fully seat in the firing chamber 26. Further, as will be appreciated by those skilled in the art, the skewed slots 194 in the barrel interface 170 tend to circumferentially and radially center the bolt lugs 110*e&f* as the bolt 180 is driven forward.

Preferably, components of the breech bolt assembly 42 and the barrel interface 170 are manufactured from a metal suitable for use in firearms using techniques known to those skilled in the art. Furthermore, it is preferred that the bolt 50 and barrel interface 170 each be formed from a single, unitary piece of material; however, in alternative embodiments, the bolt and the barrel interface may each be made by coupling two or more separate components as would occur to one skilled in the art. Also, it is contemplated that the bolt assembly 42, the bolt 50, and the barrel interface 170 may be formed from different materials suitable for their intended purpose.

As will be apparent to those skilled in the art, existing firearms may be modified to improve their reliability, and newly manufactured firearms may be originally manufactured to include the bolt claimed below. When modifying an existing firearm, a used breech bolt may be removed from the firearm, and a new breech bolt having the claimed characteristics may be installed in the firearm. Alternatively, a used bolt may be removed from the firearm, reworked to conform to the claimed characteristics, and installed back in the firearm.

As used herein, the term firearm is intended to include rifles, shotguns, pistols, and other portable guns. Further, the term firearm is not intended to be limited to center-fire weapons as described above.

All publications and patent applications cited in this specification are herein incorporated by reference as if each individual publication or patent application were specifically and individually indicated to be incorporated by reference.

Having described the invention in detail, it will be apparent that modifications and variations are possible without departing from the scope of the invention defined in the appended claims. Although specific language is used to describe features of the illustrated embodiment, it should be understood that no limitation of the scope of the invention is thereby intended. Any alterations and further modifications in the described device, and any further applications of the principles of the invention as described herein are contemplated as would normally occur to one skilled in the art(s) to which the invention relates.

When introducing elements of the present invention or the preferred embodiment(s) thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A firearm for firing a projectile from a cartridge including a shell casing having a hollow interior, propellant in the interior of the shell casing, and the projectile mounted at a forward end of the shell casing, said firearm comprising:

a receiver having a cavity therein and a barrel interface at a forward end thereof, the barrel interface including a bolt interlocking chamber and a plurality of receiver lugs spaced by gaps and extending inward behind the bolt interlocking chamber;

an elongate barrel mounted on the barrel interface for directing the projectile forward when fired from the cartridge, the barrel including a firing chamber at a rearward end for holding the cartridge prior to firing the projectile and for holding the shell casing after the projectile is fired, the firing chamber being positioned in front of the bolt interlocking chamber;

a breech bolt assembly mounted in the receiver cavity behind the barrel interface for loading the cartridge in the firing chamber from a cartridge source prior to firing, and extracting the shell casing from the firing chamber after firing, the bolt assembly comprising:

a bolt including an elongate cylindrical body portion having a longitudinal centerline, a lug portion extending forward from the body portion, and a firing pin bore extending longitudinally through the bolt, said lug portion including a plurality of lugs extending outward therefrom, a cartridge recess at a front end sized and shaped for holding a rearward end of the cartridge therein, an extractor cavity extending to the cartridge recess, and an off-center longitudinal hole at least partially aligned with the cartridge recess, said plurality of lugs being spaced to correspond to the gaps between the receiver lugs so that the plurality of bolt lugs can slide forward through the gaps and rotate about the centerline of the body portion to align at least one of the plurality of bolt lugs with at least one of the plurality of receiver lugs;

an extractor pivotally mounted in the extractor cavity and biased to hold the cartridge in the cartridge recess; and an ejector pin slidably received in the off-center longitudinal hole, the pin being biased to eject the shell casing from the cartridge recess; and a trigger assembly including a firing pin slidably received in the firing pin bore of the bolt and aligned with the cartridge when received in the cartridge recess and firing chamber for initiating firing of the projectile from the cartridge;

wherein the at least one of the plurality of lugs on the lug portion of the bolt has an outer surface that tapers so a rearward surface of the respective lug has a greater radial height than a forward surface;

wherein the outer surface of the respective lug includes a forward part having a greater radial height on one side of a circumferential centerline than on another side of the circumferential centerline; and wherein the forward part has a front portion and a rear portion such that on one side of the circumferential centerline, the forward part has a different radius of curvature at the front portion and the rear portion.

2. The firearm as set forth in claim 1, wherein each tapered outer surface is rounded.

3. The firearm as set forth in claim 2, wherein each tapered outer surface has a smaller radius of curvature on the one side of the circumferential centerline than on the other.

4. The firearm as set forth in claim 2, wherein each tapered outer surface is asymmetrically rounded about the circumferential centerline.

5. A breech bolt assembly for mounting in a firearm for loading a cartridge in a firing chamber of the firearm prior to firing a projectile from the cartridge and extracting a shell casing from the firing chamber after firing, the bolt assembly comprising:

a bolt including an elongate cylindrical body portion having a longitudinal centerline, a lug portion extending forward from the body portion, and a firing pin bore extending longitudinally through the bolt, said lug portion including a plurality of spaced lugs extending outward therefrom, a cartridge recess at a front end sized and shaped for holding a rearward end of the cartridge therein, an extractor cavity extending to the cartridge recess, and an off-center longitudinal hole at least partially aligned with the cartridge recess;

an extractor pivotally mounted in the extractor cavity and biased to hold the cartridge in the cartridge recess; and an ejector pin slidably received in the off-center longitudinal hole, the pin being biased to eject the shell casing from the cartridge recess;

wherein the at least one of the plurality of lugs on the lug portion of the bolt has an outer surface that tapers so a rearward surface of the respective lug has a greater radial height than a forward surface;

wherein the outer surface of the respective lug includes a forward part having a greater radial height on one side of a circumferential centerline than on another side of the circumferential centerline; and wherein the forward part has a front portion and a rear portion such that on one side of the circumferential centerline, the forward part has a different radius of curvature at the front portion and the rear portion.

6. The breech bolt assembly as set forth in claim 5, wherein at least one of the plurality of lugs on the lug portion of the bolt without a tapering outer surface has side surfaces that taper so the rearward surface of the respective lug is wider than the forward surface of the respective lug.

7. A breech bolt assembly for mounting in a firearm for loading a cartridge in a firing chamber of the firearm prior to firing a projectile from the cartridge and extracting a shell casing from the firing chamber after firing, the bolt assembly comprising:

a bolt including an elongate cylindrical body portion having a longitudinal centerline, a lug portion extending forward from the body portion, and a firing pin bore extending longitudinally through the bolt, said lug portion including a plurality of spaced lugs extending outward therefrom, a cartridge recess at a front end sized and shaped for holding a rearward end of the cartridge therein, an extractor cavity extending to the cartridge recess, and an off-center longitudinal hole at least partially aligned with the cartridge recess;

an extractor pivotally mounted in the extractor cavity and biased to hold the cartridge in the cartridge recess; and an ejector pin slidably received in the off-center longitudinal hole, the pin being biased to eject the shell casing from the cartridge recess;

wherein at least two of the plurality of lugs on the lug portion of the bolt have an outer surface that tapers so a rearward surface of the respective lug has a greater radial height than a forward surface;

wherein the outer surface of each respective lug includes a forward part that is circumferentially tapered, having a greater radial height on one side of a circumferential centerline than on another side of the circumferential centerline; and wherein the forward part has a front portion and a rear portion such that on one side of the circumferential centerline, the forward part has a different radius of curvature at the front portion and the rear portion.

8. A breech bolt assembly for mounting in a firearm for loading a cartridge in a firing chamber of the firearm prior to firing a projectile from the cartridge and extracting a shell casing from the firing chamber after firing, the bolt assembly comprising:

a bolt including an elongate cylindrical body portion having a longitudinal centerline, a lug portion extending forward from the body portion, and a firing pin bore extending longitudinally through the bolt, said lug portion including a plurality of spaced lugs extending outward therefrom, a cartridge recess at a front end sized and shaped for holding a rearward end of the cartridge therein, an extractor cavity extending to the cartridge recess, and an off-center longitudinal hole at least partially aligned with the cartridge recess;

an extractor pivotally mounted in the extractor cavity and biased to hold the cartridge in the cartridge recess; and an ejector pin slidably received in the off-center longitudinal hole, the pin being biased to eject the shell casing from the cartridge recess;

wherein at least one of the plurality of lugs on the lug portion of the bolt has an outer surface that tapers so a rearward surface of the respective lug has a greater radial height than a forward surface;

wherein the outer surface of the respective lug includes a forward part that is asymmetrically rounded, having a larger radius of curvature on one side of a circumferential centerline than on another side of the circumferential centerline; and wherein the forward part has a front portion and a rear portion such that on one side of the circumferential centerline, the forward part has a different radius of curvature at the front portion and the rear portion.

9. A firearm for firing a projectile from a cartridge including a shell casing having a hollow interior, propellant in the interior of the shell casing, and the projectile mounted at a forward end of the shell casing, said firearm comprising:

a receiver having a cavity therein and a barrel interface at a forward end thereof, the barrel interface including a bolt interlocking chamber and a plurality of receiver lugs spaced by circumferentially symmetrical gaps and extending inward behind the bolt interlocking chamber;

an elongate barrel mounted on the barrel interface for directing the projectile forward when fired from the cartridge, the barrel including a firing chamber at a rearward end for holding the cartridge prior to firing the projectile and for holding the shell casing after the projectile is fired, the firing chamber being positioned in front of the bolt interlocking chamber;

a breech bolt assembly mounted in the receiver cavity behind the barrel interface for loading the cartridge in the firing chamber from a cartridge source prior to firing, and extracting the shell casing from the firing chamber after firing, the bolt assembly comprising:

a bolt including an elongate cylindrical body portion having a longitudinal centerline, a lug portion extending forward from the body portion, and a firing pin bore extending longitudinally through the bolt, said lug portion including a plurality of lugs extending outward therefrom, a cartridge recess at a front end sized and shaped for holding a rearward end of the cartridge therein, an extractor cavity extending to the cartridge recess, and an off-center longitudinal hole at least partially aligned with the cartridge recess, said plurality of lugs being spaced to correspond to the gaps between the receiver lugs so that the plurality of bolt lugs can slide forward through the gaps and rotate about the centerline of the body portion to align at least one of the plurality of bolt lugs with at least one of the plurality of receiver lugs;

an extractor pivotally mounted in the extractor cavity and biased to hold the cartridge in the cartridge recess; and an ejector pin slidably received in the off-center longitudinal hole, the pin being biased to eject the shell casing from the cartridge recess; and a trigger assembly including a firing pin slidably received in the firing pin bore of the bolt and aligned with the cartridge when received in the cartridge recess and firing chamber for initiating firing of the projectile from the cartridge;

wherein the at least one of the plurality of lugs on the lug portion of the bolt has an outer surface that tapers so a rearward surface of the respective lug has a greater radial height than a forward surface;

wherein the outer surface of the respective lug has less volume on one forward outer corner than on another forward outer corner so that the bolt tends to circumferentially rotate in a direction away from the corner having less volume when contacting the receiver lugs as the bolt slides forward in the receiver cavity; and wherein the outer surface has a front portion and a rear portion such that on one side of a circumferential centerline, the outer surface has a different radius of curvature at the front portion and the rear portion.

10. The firearm as set forth in claim 9, wherein each forward outer corner having less volume slopes radially inward between the circumferential centerline of the lug and the corner having less volume.

11. The firearm as set forth in claim 10, wherein each forward outer corner having less volume is rounded between the circumferential centerline of the lug and the corner having less volume.

12. The firearm as set forth in claim 9, wherein at least part of each tapered outer surface has a greater radial height on one side of the circumferential centerline than on another side of the circumferential centerline.

13. The firearm as set forth in claim 9, wherein each tapered outer surface is rounded.

14. The firearm as set forth in claim 13, wherein each tapered outer surface has a smaller radius of curvature on the one side of the circumferential centerline than on the other.

15. The firearm as set forth in claim 13, wherein each tapered outer surface is asymmetrically rounded about the circumferential centerline.

16. The firearm as set forth in claim 9, wherein each lug having less volume on one forward outer corner is asymmetrically rounded at the forward surface, having a larger radius of curvature on one side of the circumferential centerline than on another side of the circumferential centerline.

* * * * *